US007328676B2

(12) United States Patent
Schnell et al.

(10) Patent No.: US 7,328,676 B2
(45) Date of Patent: Feb. 12, 2008

(54) HYDRAULIC VALVE PLAY COMPENSATION ELEMENT

(75) Inventors: Oliver Schnell, Veitsbronn (DE); Christian Schaefer, Nuremberg (DE); Peter Sailer, Erlangen (DE)

(73) Assignee: Schaeffler KG, Herzogenaurach (DE)

( * ) Notice: Subject to any disclaimer, the term of this patent is extended or adjusted under 35 U.S.C. 154(b) by 125 days.

(21) Appl. No.: 11/370,633

(22) Filed: Mar. 8, 2006

(65) Prior Publication Data

US 2006/0201466 A1 Sep. 14, 2006

(30) Foreign Application Priority Data

Mar. 9, 2005 (DE) ..... 10 2005 010 711

(51) Int. Cl.
*F01L 1/14* (2006.01)

(52) U.S. Cl. ..... 123/90.52; 123/90.53; 123/90.55

(58) Field of Classification Search ..... 123/90.52, 123/90.53, 90.55, 90.35, 90.36, 90.46
See application file for complete search history.

(56) References Cited

U.S. PATENT DOCUMENTS 4,054,109 A 10/1977 Herrin et al.

FOREIGN PATENT DOCUMENTS

| | | |
|---|---|---|
| DE | 195 25 948 | 1/1997 |
| DE | 10 2004 018 457 | 11/2005 |
| EP | 1 298 287 | 4/2003 |
| JP | 61-185607 | 8/1986 |
| JP | 61185607 | 8/1986 |

*Primary Examiner*—Zelalem Eshete
(74) *Attorney, Agent, or Firm*—Volpe and Koenig, PC

(57) ABSTRACT

A hydraulic valve play compensation element for an internal combustion engine is provided as a reverse-spring/free-ball element, with a cylindrical housing, a cylindrical piston (21) guided therein with sealing play and a control valve (20), which is arranged between a low-pressure chamber (22) of the piston (21) and a high-pressure chamber (24) of the housing, on a piston head (25) of the piston and which has a closing body (27), which can contact a valve seat (26) surrounding an axial bore hole (23) of the piston head (25) when carrying out a stroke (28) in the closing direction against the force of a control-valve spring (34) and which can contact a contact surface (29) of a valve cap (30) surrounding the closing body (27) when carrying out a stroke in the opening direction. In a region of the axial bore hole (23) for the closing body (27) there is a narrow guidance surface (32) with gaps, which enable a volume flow of hydraulic medium between the high-pressure chamber (24) and the low-pressure chamber (22).

7 Claims, 5 Drawing Sheets

HYDRAULIC VALVE PLAY COMPENSATION ELEMENT

BACKGROUND

The invention relates to a hydraulic valve play compensation element for the control drive of an internal combustion engine, which is provided as a reverse-spring/free-ball element, with a cylindrical housing, a cylindrical piston guided therein with sealing play, and a control valve, which is arranged between a low-pressure chamber of the piston and a high-pressure chamber of the housing on a piston head and which has a closing body, which can contact a valve seat surrounding an axial bore hole of the piston head when carrying out a stroke in the closing direction against the action of a control-valve spring and which can contact a contact surface of a valve cap surrounding the closing body in the opening direction.

Hydraulic valve play compensation elements are used for compensating for the play formed due to wear and tear or heat expansion when the cam stroke is transferred between transmission elements from a camshaft to a gas-exchange valve of the internal combustion engine. Through the use of the compensation element, a low-noise and low-wear operation of the valve drive and the best possible matching of the cam lift with the stroke of the gas-exchange valve should be achieved.

Such compensation elements each have a control valve, which is provided as a non-return valve and which has a closing body, for example a ball, and a control-valve spring applying a force onto the closing body. In the standard construction of the control valve, the control-valve spring applies a force on the closing body in the closing direction. Therefore, the control valve is predominantly closed and the return stroke of the valve lay compensation element is eliminated. In this configuration, there is the risk of pumping the compensation element upwards and producing a "negative valve lash."

These disadvantages are avoided with control valves, whose control-valve spring applies a force on the closing body in the opening direction, or control valves, in which a spring is completely eliminated. Compensation elements with such a control valve are designated as reverse-spring elements due to the inverted arrangement of the control-valve spring or as free-ball elements due to the lack of a spring. These exert a positive influence on the thermodynamics, the pollutant emissions, and the mechanical stress on the internal combustion engine and are therefore being used increasingly.

In the standard construction, the control valve is predominantly closed in the base-circle region of the cam due to the spring force of the control-valve spring. In a reverse-spring element, however, the control valve in this region is held open by the force of the control-valve spring. In a free-ball element, the closing is not forced. Because such an element can be closed only by hydrodynamic and hydrostatic forces from the lubricating-oil flow set at the beginning of the cam lift and flowing from the high-pressure chamber to the low-pressure chamber, the element always has a return stroke before the beginning of the valve stroke of the gas-exchange valve. The size of the return stroke depends on the length of the closing time of the control valve at each engine rpm and this depends, in turn, on the viscosity/density of the lubricating oil, which here is used in a known way as hydraulic medium.

To close the control valve of a reverse-spring/free-ball element, a so-called critical lubricating-oil speed is necessary. This depends on the lubricating-oil viscosity and thus on the lubricating-oil temperature. For a high lubricating-oil viscosity/density, i.e., for a low lubricating-oil temperature, the critical lubricating-oil speed is lower and is therefore reached more quickly than for a lower lubricating-oil viscosity, thus a high lubricating-oil temperature. For a cold start, this leads to a shorter closing time of the control valve and thus to a smaller return stroke than for a warm-running engine. However, a small return stroke means a large valve overlap. This results in a high internal exhaust-gas recirculation, which causes noisy, low idle running. This can be improved by raising the idling rpm, but leads to costs in terms of pollutant emissions and fuel consumption.

Reverse-spring/free-ball elements of the type named above are known, for example, from EP 1 298 287 A2, JP 61-185607, and U.S. Pat. No. 4,054,109. These publications present compensation elements, for which the control valve has a ball bearing as a closing body. In these known publications, the closing body is guided in bore holes. However, because lubricating oil must flow around the closing body for closing the control valve, the guide gap cannot be selected arbitrarily small. Therefore, the closing body is not guided ideally, which leads to deviations in the closing behavior. On the other side, surrounding the closing body with oil is necessary to be able to define the closing behavior. Here, the closing behavior exhibits considerable thermal dependence.

Thus, for reverse-spring/free-ball elements, the closing body of the control valve is open in the base circle of the cam. For closing the control valve, a volume flow must flow past the closing body, which causes a pressure difference on the closing body, whereby this closes the control valve. To keep the tolerances of the generated return stroke small, the stroke of the closing body should fluctuate as little as possible. In addition, an eccentric gap between the closing body and the guide wall surrounding it has a negative effect on the flow, whereby the closing behavior is also influenced.

SUMMARY OF THE INVENTION

The invention is based on the objective of achieving improved guidance of the closing body, so that the closing body cannot deviate from its movement track. In this way, the stroke tolerance should be clearly limited.

According to the invention, this objective is met in that, in the region of the axial bore hole for the closing body, a narrow guidance surface is formed with gaps, which enable a volume flow of hydraulic medium between the high-pressure chamber and the low-pressure chamber. So that the closing behavior is not negatively affected, despite the better guidance, the closing body according to the invention is guided with discontinuous geometries.

The gaps can be formed by groove-shaped channels, which are incorporated into the inner surface of the piston head located on the axial bore hole. The closing body can have outwardly projecting guidance ribs on its outer surface, which form gaps, which are spaced apart one behind the other in the peripheral direction, and which are directed towards the valve cap. On its inner surface, the valve cap can also have guidance ribs, which form the gaps. The guidance ribs project from the valve cap in the peripheral direction with spacing one behind the other towards the closing body.

Due to the channels or guidance ribs, a good guidance of the closing body is achieved, wherein the control valve can pass sufficient hydraulic medium through the gaps, so that the closing behavior is not worsened. If the gaps, through which the hydraulic medium flow, are located on the closing body itself, this is a useful configuration in that it cannot tilt about its height axis, so that a clean seal is realized on the valve seat of the control valve.

Corresponding advantages can be achieved if gaps, which enable a volume flow of hydraulic medium between the high-pressure chamber and the low-pressure chamber, are provided in the region of the axial bore hole on a narrow guidance surface for the control-valve spring. In this way, the gaps can be formed by groove-shaped channels, which are incorporated into the inner surface of the piston head located around the axial bore hole.

A tight guidance of the control-valve spring has the effect that this cannot change direction. In this way, spring force tolerances and thus deviations in the closing behavior of the control valve are reduced. Through the gaps in the guidance of the control-valve spring, the flow of hydraulic medium is not impaired, but instead it is improved even more. However, the gaps may not extend into the valve seat, so that the control valve can be sealed securely.

BRIEF DESCRIPTION OF THE DRAWINGS

Preferred embodiments of the invention are shown in the drawing and are described in more detail below. In the drawings.

DETAILED DESCRIPTION OF THE PREFERRED EMBODIMENTS

Figure 9:
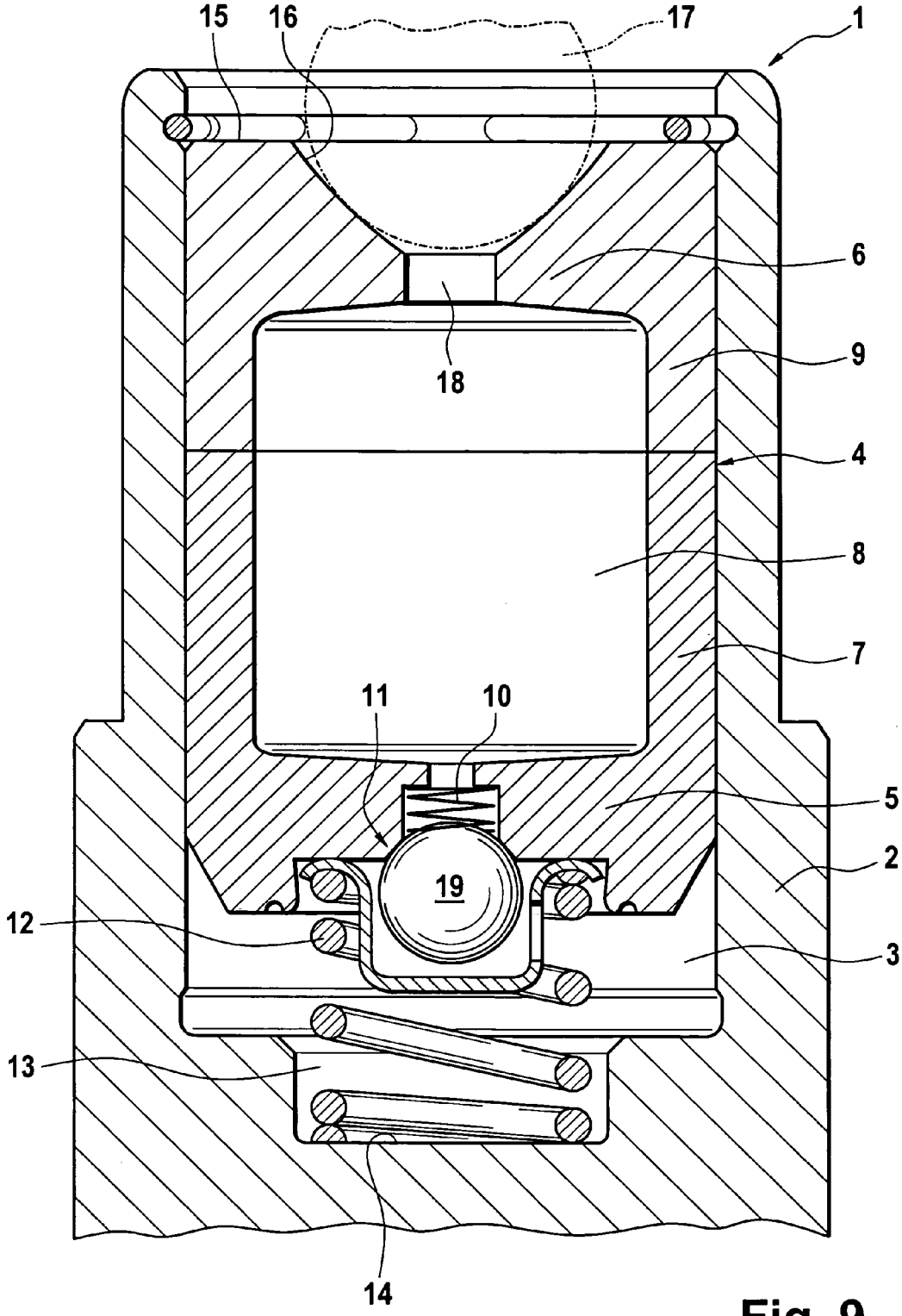
FIG. 9 is a longitudinal cross-sectional view of a reverse-spring/free-ball element with a conventionally guided closing body of the control valve.

The valve play compensation element shown in FIG. 9 is provided as a hydraulic roller tappet 1. This has a rotationally symmetric housing 2 with a roller (not shown) arranged on the bottom end. The housing 2 has a stepped pocket hole, which forms a high-pressure chamber 3 and in which a hollow cylindrical piston 4 is guided with sealing play. The piston 4 has a bottom piston head 5 and a top piston head 6. It is divided horizontally into a piston bottom part 7 and a piston top part 9. Underneath the bottom piston head 5 there is the high-pressure chamber 3. Above the bottom piston head 5 there is a low-pressure chamber 8, which is formed by the interior of the piston 4 and which is used as an oil storage space.

The high-pressure chamber 3 is connected to the low-pressure chamber 8 by a central axial bore hole, which is arranged in the bottom piston head 5. It is part of a control valve 11 provided with a control-valve spring 10. This extends into the high-pressure chamber 3 underneath the bottom piston head 5. A compression spring 12 is supported in a central recess 13 on the base 14 of the high-pressure chamber 3. It acts on the piston 4 and thus the entire valve drive with its compressive force. The top piston head 6 has on its outer surface 15 a central conical recess 16 for guiding, for example, the ball-shaped end 17 of a not-shown tappet push-rod. Another central axial bore hole 18, which is located in the top piston head 6, creates the connection of the low-pressure chamber 8 with the lubricating-oil supply of the valve drive. The closing body 19 of this compensation element is a ball.

Figure 1:
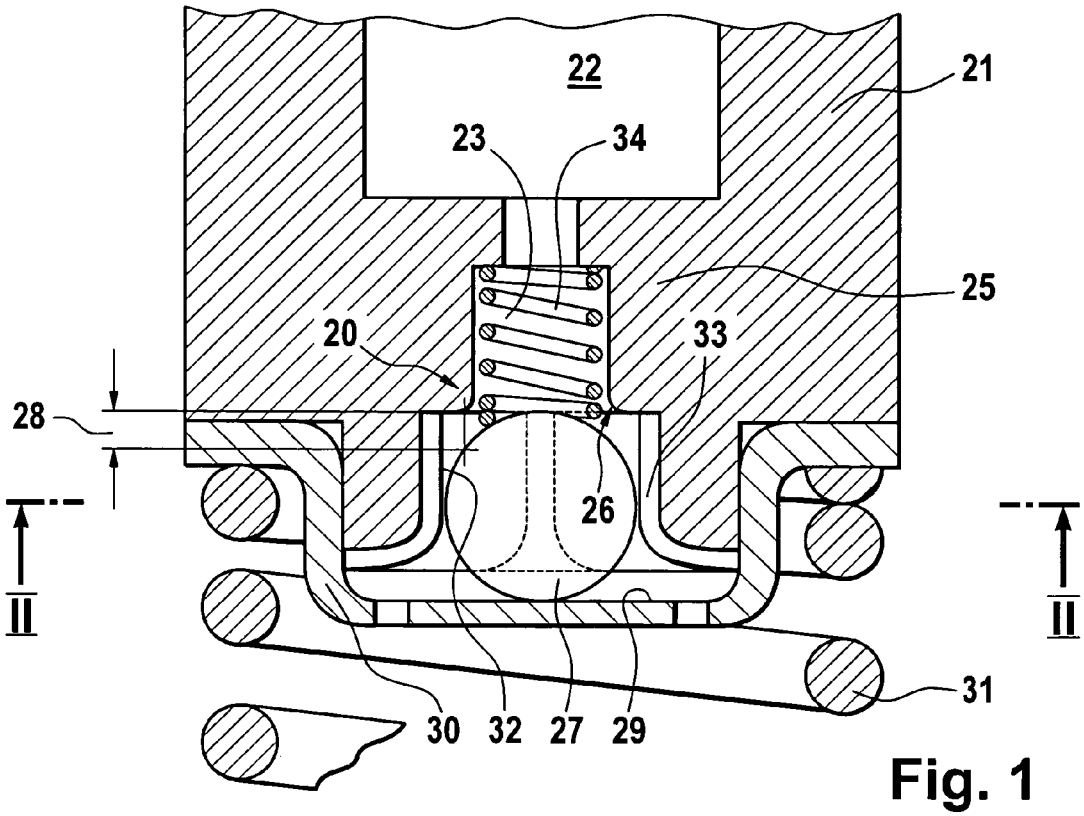
FIG. 1 is a longitudinal cross-sectional view in a region of the control valve of a reverse-spring/free-ball element in a first embodiment according to the invention.
Figure 2:
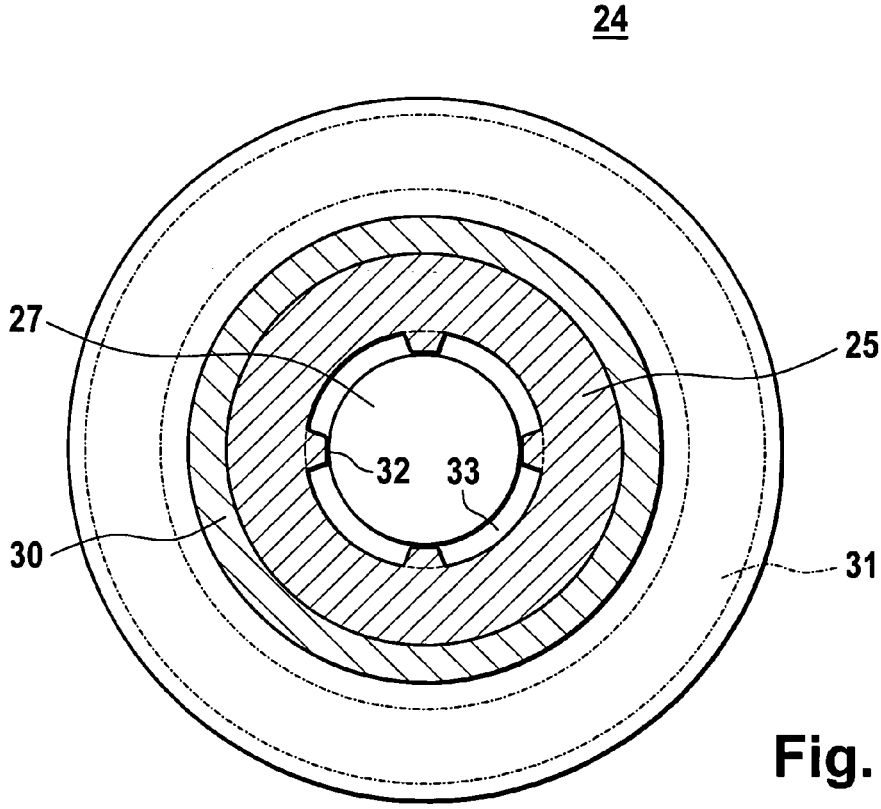
FIG. 2 is a view of the control-valve region in a cross section extending through the closing body taken along line II-II of FIG. 1.

The control valve 20 according to the invention shown in FIGS. 1 and 2 is attached to a piston 21 of a valve lay compensation element. In this element, a low-pressure chamber 22 is connected via an axial bore hole 23 to the high-pressure chamber 24 of the compensation element, which is located underneath the piston head 25. The axial bore hole 23 is a stepped bore hole and forms a valve seat 26 for a closing body 27, which is provided as a ball and whose stroke 28 is limited in the direction towards the piston 21. In the opposite direction of movement for the closing body 27, the stroke 28 is limited by a contact surface 29 of a valve cap 30, which surrounds the closing body 27 and is located with a flange region between the piston head 25 and the top end of a compression spring 31 of the compensation element. The closing body 27 is located in a longitudinal section of the axial bore hole 23 and is guided there when the stroke 28 is pressed on the inner surface of the piston head 25. The surface acting as the guidance surface 32 has several gaps, which are arranged one behind the other in the peripheral direction and which extend in the axial direction, so that channels 33 are formed there, through which hydraulic medium can flow to the closing body 27. Here, the gaps are located in the piston. The control valve 20 is held first by a control-valve spring 34 in the open position. The control-valve spring 34 is arranged in the axial bore hole 23 and is supported with one end on the piston head 25 and with the other end on the closing body 27. Due to the volume flow of the hydraulic medium on the closing body 27, a pressure differential is created on the closing body, whose compressive force counteracts and overcomes the force of the control-valve spring 34. In this way, the closing body 27 contacts the valve seat 26 and thus the control valve 20 is closed.

Figure 3:
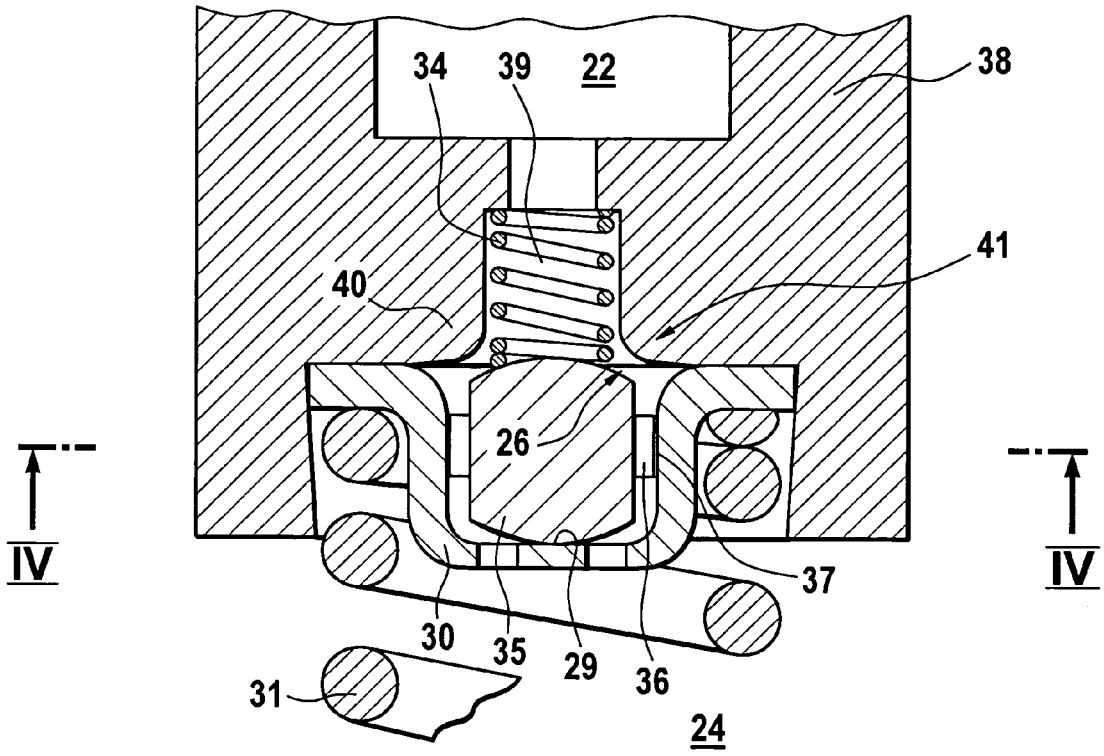
FIG. 3 is a longitudinal cross-sectional view of the control-valve region in a second embodiment according to the invention.
Figure 4:
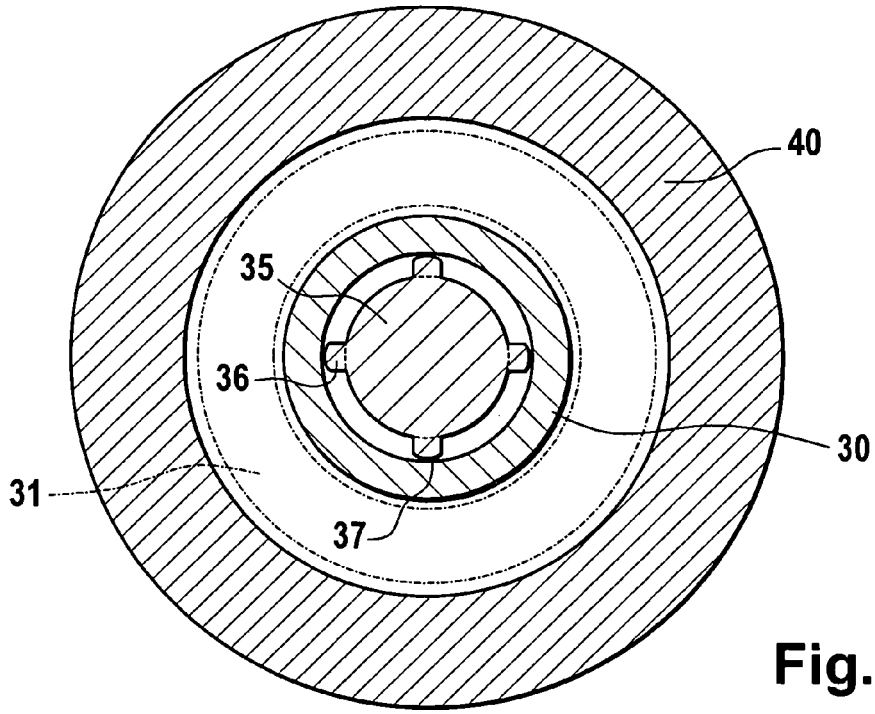
FIG. 4 is a view of the control-valve region in a cross section extending through the closing body along line IV-IV of FIG. 3.

The compensation element according to FIGS. 3 and 4 differs from this configuration essentially only in that the gaps are not in the piston, but instead on the closing body 35. This is cylindrical and provided with convexly curved ends. Due to the gaps, it has on its outer surface projecting guidance ribs 36 with guidance surfaces 37, which are provided for contacting the valve cap 30 surrounding the closing body 35. Accordingly, the construction of the piston 38 is slightly modified with its axial bore hole 39, its piston head 40, and its control valve 41.

Figure 5:
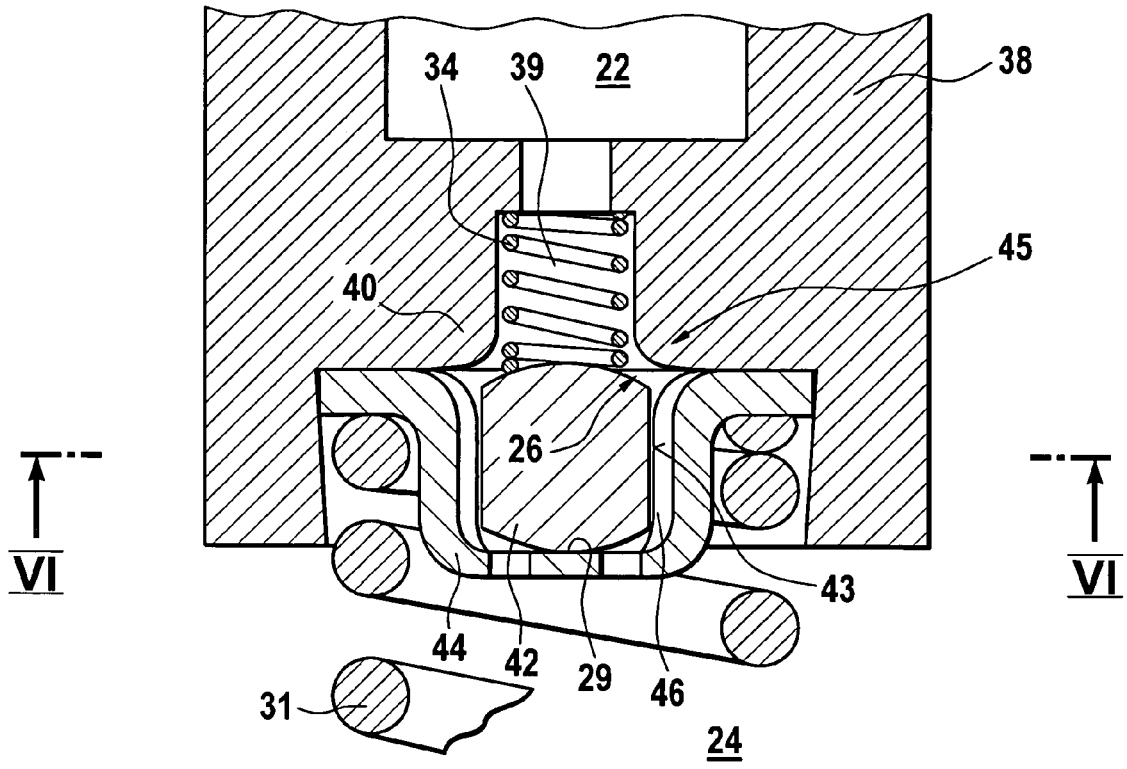
FIG. 5 is a longitudinal cross-sectional view of the control-valve region in a third embodiment according to the invention.
Figure 6:
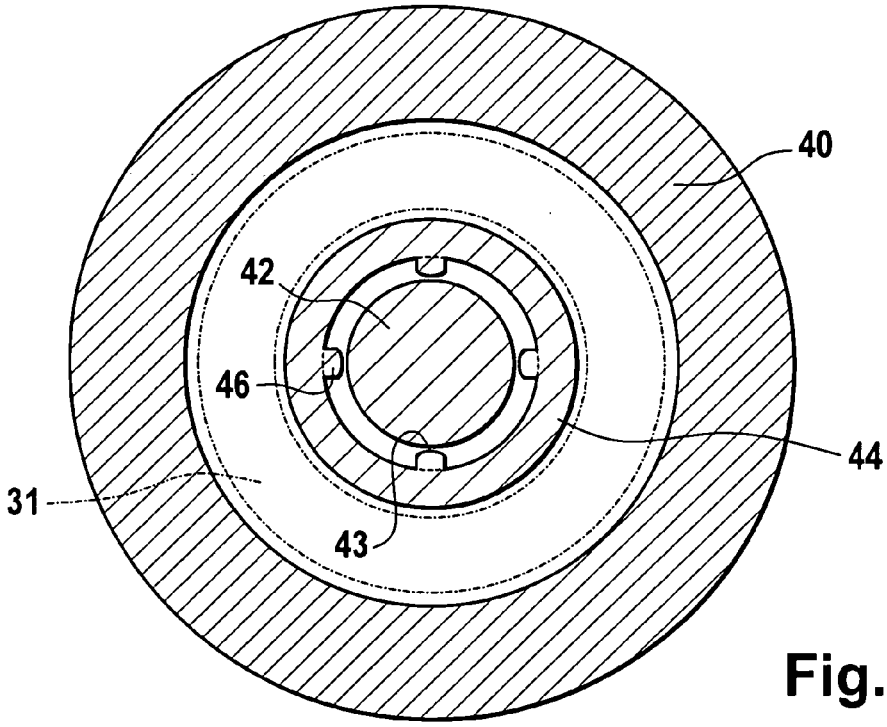
FIG. 6 is a view of the control-valve region in a cross section extending through the closing body along line VI-VI of FIG. 5.

In the similar configuration according to FIGS. 5 and 6, the closing body 42 is also guided by a guidance surface 43 of a valve cap 44, wherein here the gaps are arranged in the valve cap 44. Therefore, in this control valve 45, several guidance ribs 46 are formed on the inner surface of the valve cap 44.

Figure 7:
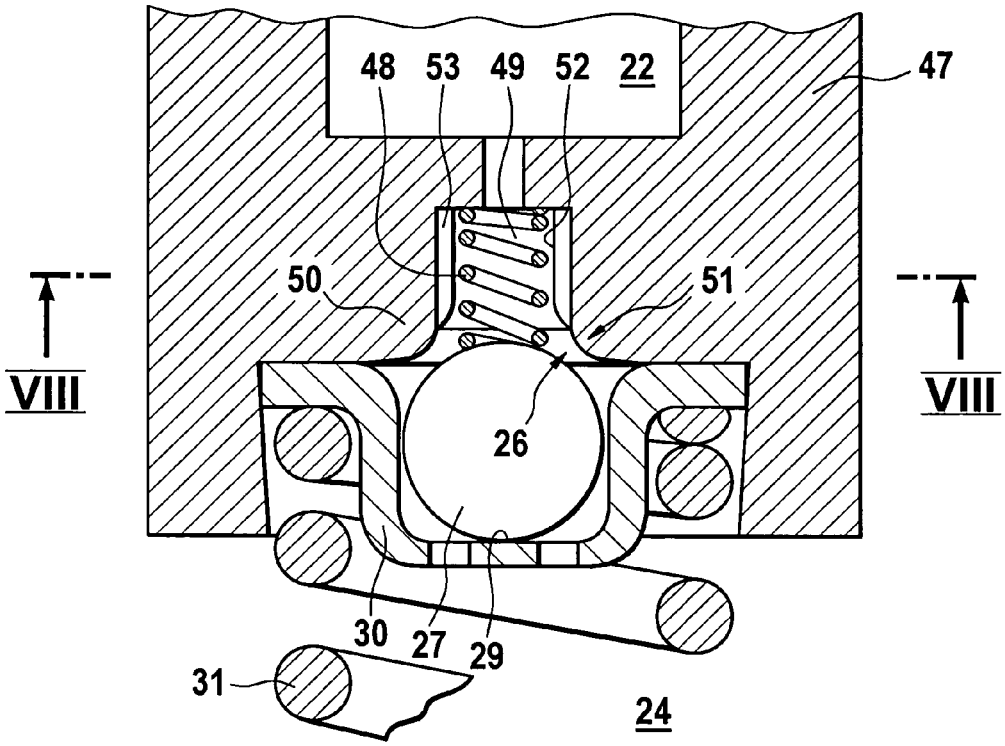
FIG. 7 is a longitudinal cross-sectional view of the control-valve region in a fourth embodiment according to the invention.
Figure 8:
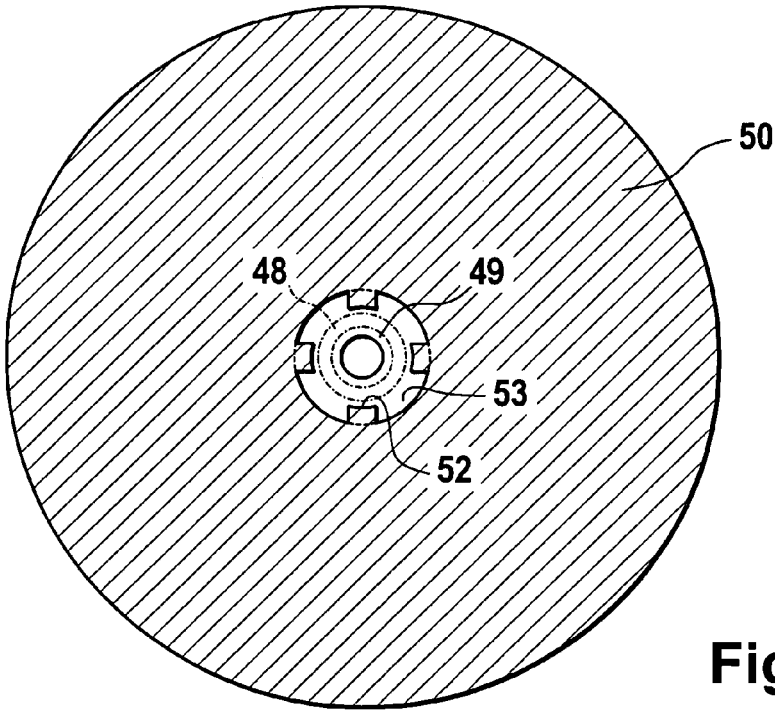
FIG. 8 is a view of the control-valve region in a cross section running through the control-valve spring along line VIII-VIII of FIG. 7.

Finally, FIGS. 7 and 8 show a configuration, in which gaps for the control-valve spring 48 are provided in the piston 47. In the region of the axial bore hole 49, which contains the control-valve spring 48, which penetrates the piston head 50, and which connects the low-pressure chamber 22 to the high-pressure chamber 24, the gaps are provided on the inner surface of the piston head 50 for the control valve 51. Therefore, there are several channels 53 arranged one behind the other in the peripheral direction on the guidance surface 52 for the control valve 48 for the passage of hydraulic medium.

LIST OF REFERENCE SYMBOLS

1 Roller tappet
2 Housing
3 High-pressure chamber
4 Piston
5 Bottom piston head
6 Top piston head
7 Piston bottom part
8 Low-pressure chamber
9 Piston top part
10 Control-valve spring
11 Control valve
12 Compression spring
13 Recess
14 Base
15 Outer surface
16 Conical recess
17 Ball-shaped end
18 Axial bore hole
19 Closing body
20 Control valve
21 Piston
22 Low-pressure chamber
23 Axial bore hole
24 High-pressure chamber
25 Piston head
26 Valve seat
27 Closing body
28 Stroke
29 Contact surface
30 Valve cap
31 Compressive spring
32 Guidance surface
33 Channel
34 Control-valve spring
35 Closing body
36 Guidance rib
37 Guidance surface
38 Piston
39 Axial bore hole
40 Piston head
41 Control valve
42 Closing body
43 Guidance surface
44 Valve cap
45 Control valve
46 Guidance rib
47 Piston
48 Control-valve spring
49 Axial bore hole
50 Piston head
51 Control valve
52 Guidance surface
53 Channel

The invention claimed is:

1. Hydraulic valve play compensation element for an internal combustion engine, comprising a reverse-spring/free-ball element, with a cylindrical housing, a cylindrical piston guided therein with sealing play, and a control valve which is arranged between a low-pressure chamber of the piston and a high-pressure chamber of the housing, on a piston head of the piston and which has a closing body, which is movable to contact a valve seat located around an axial bore hole in the piston head when carrying out a stroke in a closing direction against a force of a control-valve spring and which is biased against a contact surface of a valve cap surrounding the closing body when carrying out a stroke in an opening direction, a region of the axial bore hole for the closing body by the spring includes narrow guidance surfaces having gaps therebetween, which maintain an axial alignment of the closing body and the valve seat as the closing body is moved in the opening and closing directions to enable a volume flow of hydraulic medium between the high-pressure chamber and the low-pressure chamber.

2. Compensation element according to claim 1, wherein the gaps are formed by groove-shaped channels, which are incorporated into an inner surface of the piston head located around the axial bore hole.

3. Compensation element according to claim 1, wherein the closing body has guidance ribs, which project from an outer surface thereof, which form gaps, which are arranged spaced apart one behind the other in a peripheral direction, and which extend toward the valve cap.

4. Compensation element according to claim 1, wherein the valve cap has, on an inner surface thereof, guidance ribs, which form the gaps spaced apart in a peripheral direction one behind the other which project towards the closing body.

5. Hydraulic valve play compensation element for an internal combustion engine, comprising a reverse-spring/free-ball element, with a cylindrical housing, a cylindrical piston guided therein with sealing play, and a control valve, which is arranged between a low-pressure chamber of the piston and a high-pressure chamber of the housing, on a piston head of the piston and which has a closing body, which can contact a valve seat surrounding an axial bore hole in the piston head when carrying out a stroke in a closing direction against a force of a control-valve spring and which can contact a contact surface of a valve cap surrounding the closing body when carrying out a stroke in an opening direction, in a region of the axial bore hole, gaps, which enable a volume flow of hydraulic medium between the high-pressure chamber and the low-pressure chamber, are provided on a narrow guidance surface for the control-valve spring.

6. Compensation element according to claim 5, wherein the gaps are formed by groove-shaped channels, which are incorporated into an inner surface of the piston head located around the axial bore hole.

7. Hydraulic valve play compensation element for an internal combustion engine, comprising a reverse-spring/free-ball element, with a cylindrical housing, a cylindrical piston guided therein with sealing play, and a control valve which is arranged between a low-pressure chamber of the piston and a high-pressure chamber of the housing, on a piston head of the piston and which has a closing body, which is movable to contact a valve seat located around an axial bore hole in the piston head when carrying out a stroke in a closing direction against a force of a control-valve spring and which can contact a contact surface of a valve cap surrounding the closing body when carrying out a stroke in an opening direction, a region of the axial bore hole for the closing body includes a narrow guidance surface having gaps, which enable a volume flow of hydraulic medium between the high-pressure chamber and the low-pressure chamber, and the closing body has guidance ribs, which project from an outer surface thereof, which form gaps, which are arranged spaced apart one behind the other in a peripheral direction, and which extend toward the valve cap.

* * * * *